US005842348A

United States Patent [19]

Kaneko et al.

[11] Patent Number: 5,842,348

[45] Date of Patent: Dec. 1, 1998

[54] SELF-CONTAINED COOLING APPARATUS FOR ACHIEVING CYROGENIC TEMPERATURES

[75] Inventors: Tomomi Kaneko; Rohana Chandratilleke; Toru Kuriyama, all of Yokohama, Japan

[73] Assignee: Kabushiki Kaisha Toshiba, Kawasaki, Japan

[21] Appl. No.: 835,430

[22] Filed: Apr. 9, 1997

Related U.S. Application Data

[63] Continuation of Ser. No. 548,046, Oct. 25, 1995, abandoned.

[30] Foreign Application Priority Data

Oct. 28, 1994 [JP] Japan ..... 6-265409

[51] Int. Cl.[6] ..... F25B 19/00

[52] U.S. Cl. ..... 62/51.1; 62/383; 335/216

[58] Field of Search ..... 335/216; 62/51.1, 62/383

[56] References Cited

U.S. PATENT DOCUMENTS

| | | | |
|---|---|---|---|
| 3,430,455 | 3/1969 | Stuart et al. | 62/51.1 |
| 3,525,229 | 8/1970 | Denhoy | 62/55.5 |
| 4,689,970 | 9/1987 | Ohguma et al. | 62/51.1 |
| 5,113,165 | 5/1992 | Ackermann | 335/216 |
| 5,379,601 | 1/1995 | Gillett | 62/51.1 |

FOREIGN PATENT DOCUMENTS

A-3621562 1/1987 Germany .

*Primary Examiner*—Ronald Capossela
*Attorney, Agent, or Firm*—Oblon, Spivak, McClelland, Maier & Neustadt, P.C.

[57] ABSTRACT

A cryogenic cooling apparatus including a vacuum container for containing an object to be cooled, at least one refrigerator for cooling the object, and a thermal switch unit. The refrigerator has a high-temperature cooling stage and a low-temperature cooling stage connected to the high-temperature cooling stage via a low-temperature cylinder. The thermal switch unit has at least one high-temperature heat transfer member attached to the high-temperature cooling stage, at least one low-temperature heat transfer member attached to the low-temperature cooling stage and separated from the high-temperature heat transfer member, and a sealed container provided between the high-temperature cooling stage and the low-temperature cooling stage. The sealed container contains the low-temperature and high-temperature heat transfer members, and a substance capable of existing as a gas or as a solid, heat conduction between the high-temperature heat transfer member and the low-temperature heat transfer member occurring via the substance when the substance is a gas. The sealed container has no communication with outside the sealed container during an operation of the thermal switch unit.

18 Claims, 11 Drawing Sheets

PLATES ATTACHED TO LOW-TEMPERATURE

PLATES ATTACHED TO HIGH-TEMPERATURE-SIDE COOLING STAGE

PLATES ATTACHED TO LOW-TEMPERATURE COOLING STAGE

PLATES ATTACHED TO HIGH-TEMPERATURE COOLING STAGE

COMB-SHAPED HEAT CONDUCTION MEMBERS

COMB-SHAPED HEAT TRANSFER MEMBERS ATTACHED TO LOW-TEMPERATURE COOLING STAGE

COMB-SHAPED HEAT TRANSFER MEMBERS ATTACHED TO HIGH-TEMPERATURE COOLING STAGE

COMB-SHAPED HEAT TRANSFER MEMBERS ATTACHED TO LOW-TEMPERATURE COOLING STAGE

COMB-SHAPED HEAT TRANSFER MEMBERS ATTACHED TO HIGH-TEMPERATURE COOLING STAGE

ROD-SHAPED

ROD-SHAPED HEAT TRANSFER MEMBERS ATTACHED TO LOW-TEMPERATURE COOLING STAGE

ROD-SHAPED HEAT TRANSFER MEMBERS ATTACHED TO HIGH-TEMPERATURE COOLING STAGE

COMB-SHAPED HEAT TRANSFER MEMBERS ATTACHED TO LOW-TEMPERATURE COOLING STAGE

COMB-SHAPED HEAT TRANSFER MEMBERS ATTACHED TO HIGH-TEMPERATURE COOLING STAGE

HELICAL PLATES

—— HELICAL PLATES ATTACHED TO HIGH-TEMPERATURE COOLING STAGE

- - - HELICAL PLATES ATTACHED TO LOW-TEMPERATURE COOLING STAGE

SELF-CONTAINED COOLING APPARATUS FOR ACHIEVING CYROGENIC TEMPERATURES

This application is a Continuation of U.S. patent application Ser. No. 08/548,046, filed on Oct. 25, 1995, now abandoned.

BACKGROUND OF THE INVENTION

1. Field of the Invention

The present invention relates to a cryogenic cooling apparatus for cooling an object such as a superconducting magnet apparatus to very low temperatures.

2. Description of the Related Art

In a conventional superconducting magnet apparatus using a superconducting coil, the superconducting coil is cooled to a superconduction transition temperature or below by a method in which the superconducting coil is directly immersed in a refrigerant such as liquid helium or by a method in which a cryogenic apparatus having a refrigerator is used.

FIG. 1 shows the structure of a conventional cryogenic cooling apparatus.

The cryogenic cooling apparatus comprises a vacuum container 2, a superconducting coil 1, located within the vacuum container 2 for generating a necessary magnetic field near the central axis of the cooling apparatus, and a refrigerator 4 for cooling the superconducting coil 1. The refrigerator 4 comprises a driving unit 4*a*, a high-temperature-side cylinder 9, a high-temperature cooling stage 7, a low-temperature-side cylinder 6, a low-temperature cooling stage 5, and a heat conduction plate 3.

The superconducting coil 1 is fixed in place by the low-temperature cooling stage 5 of the refrigerator 4 near the central part of the vacuum container 2, with the heat conduction plate 3 interposed between the coil 1 and the cooling stage 5. The coil 1 is cooled to about 4 K by the low-temperature cooling stage 5.

The low-temperature cooling stage 5 is attached to the high-temperature cooling stage 7 at a predetermined distance, with the low-temperature-side cylinder 6 of the refrigerator 4 interposed between the cooling stage 5 and cooling stage 7. A thermal shield 8 that shields the superconducting coil from surrounding heat radiation is provided inside the vacuum container 2. A multi-layer heat insulating member is wound around the thermal shield 8.

The thermal shield 8 is cooled to a steady-state temperature by the high-temperature cooling stage 7 of the refrigerator 4. The high-temperature cooling stage 7 is connected to the driving unit 4*a* of the refrigerator 4, with the high-temperature-side cylinder 9 interposed therebetween.

A pipe 10 for pre-cooling the superconducting coil 1 and the thermal shield 8 by liquid nitrogen is provided in contact with the outer periphery of the superconducting coil 1 and the outer periphery of the thermal shield 8.

A method of cooling the superconducting magnet apparatus using the cryogenic cooling apparatus having the above structure will now be described.

At first, the superconducting coil 1 of the superconducting magnet apparatus is cooled by the low-temperature cooling stage 5 of the refrigerator 4.

In this case, refrigeration capacity of the low-temperature cooling stage 5 of the refrigerator 4 is low. Thus, in order to efficiently cool the superconducting coil 1 from room temperature to very low temperatures, a refrigerant such as liquid nitrogen is generally used in combination.

Specifically, the superconducting coil 1 is cooled from room temperature to about 77 K corresponding to saturation of liquid nitrogen by liquid nitrogen flowing in the pre-cooling pipe 10. Then, the coil 1 is cooled to a lower temperature, for instance to 4 K by means of the low-temperature lower cooling stage 5 alone of refrigerator 4.

On the other hand, the thermal shield 8 is cooled from room temperature to a steady-state temperature by the high-temperature cooling stage 7 of the refrigerator 4, thereby reducing heat radiation from room temperature environment to the superconducting coil 1.

After the superconducting coil 1 and thermal shield 8 each have been cooled to a steady-state temperature, an electric current is supplied from a current lead and a necessary magnetic field is generated by the superconducting coil 1.

Liquid nitrogen supplied into the pipe 10 is used only at the time of pre-cooling the thermal shield 8 and superconducting coil 1. In the normal operation mode of the superconducting magnet, the pipe 10 is set in a vacuum state and the superconducting state of the superconducting coil 1 is maintained only by the refrigerator 4.

In cooling the superconducting coil 1 by using the above cryogenic cooling means, a refrigerant such as liquid nitrogen is needed for every pre-cooling process. Thus, the handling of the magnet apparatus is time-consuming in the cases when a magnetic needs to be generated in relatively short time or the magnetic field needs to be generated frequently.

Even when the superconducting coil 1 is cooled by the refrigerator from room temperatures, a long cooling time is required, because the refrigeration capacity of low temperature cooling-stage is very low.

SUMMARY OF THE INVENTION

The present invention has been made in consideration of the above circumstances, and an object thereof is to provide a cryogenic cooling apparatus having a thermal switch wherein cooling can be efficiently performed in a range from room temperature to a lower temperature, without using a refrigerant for cooling an object such as a superconducting coil.

According to an aspect of the invention, there is provided a cryogenic cooling apparatus including a vacuum container for containing an object to be cooled, and at least one refrigerator for cooling the object, the refrigerator being provided with a high-temperature cooling stage and a low-temperature cooling stage arranged at a predetermined distance from each other with a low-temperature-side cylinder interposed between both stages, wherein the cryogenic cooling apparatus further includes a thermal switch comprising:

at least one high-temperature-side heat transfer member attached to the high-temperature cooling stage of the refrigerator;

at least one low-temperature-side heat transfer member attached to the low-temperature cooling stage of the refrigerator, at least one low-temperature-side heat transfer member being situated to face at least one high-temperature-side heat transfer member at a small distance therebetween; and a sealed container for containing at least one high-temperature-side heat transfer member and at least one low-temperature-side heat transfer member, the sealed container being filled with a cryogenic gas for heat conduction between at least one high-temperature-side heat transfer member and at least one low-temperature-side heat transfer member.

According to the cryogenic cooling apparatus of the present invention, the thermal switch is turned on by heat conduction via the gas filled in the gaps between the heat transfer members. If the temperature of the gas reaches the boiling point and then a triple point, the gas is solidified and the heat transport between the heat transfer members is limited only to a slight heat transport by radiation. As a result, the thermal switch is turned off. Therefore, the object can be cooled by only the refrigerator of the cryogenic cooling apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DESCRIPTION OF THE PREFERRED EMBODIMENTS

Cryogenic cooling apparatuses according to preferred embodiments of the present invention will now be described with reference to the accompanying drawings.

<First Embodiment>

Figure 1:
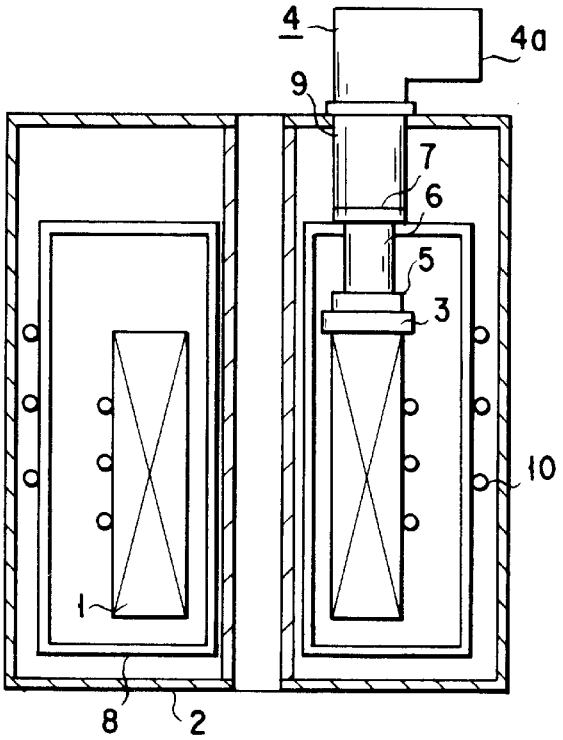
FIG. 1 (PRIOR ART)
FIG. 1 shows the structure of a conventional cryogenic cooling apparatus.
Figure 2:
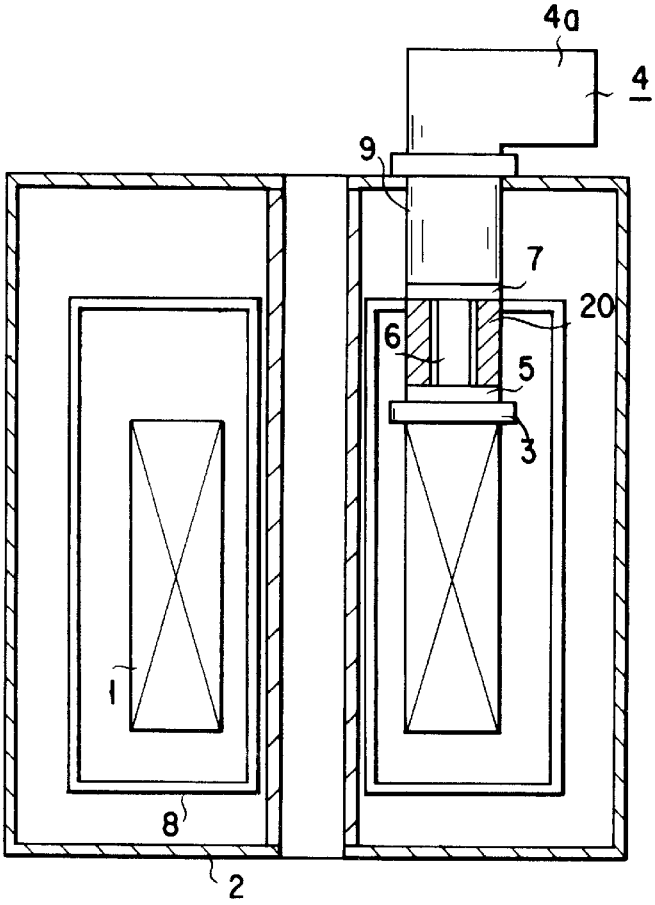
FIG. 2 shows the structure of a cryogenic cooling apparatus according to a first embodiment of the present invention.

FIG. 2 shows the structure of a cryogenic cooling apparatus according to a first embodiment of the present invention. The structural elements common to those shown in FIG. 1 are denoted by like reference numerals.

As shown in FIG. 2, the cryogenic cooling apparatus of this embodiment is characterized in that a thermal switch 20 is provided between the low-temperature cooling stage 5 of refrigerator 4 for cooling the superconducting coil 1 and the high-temperature cooling stage 7 for cooling the thermal shield 8.

Figure 3:
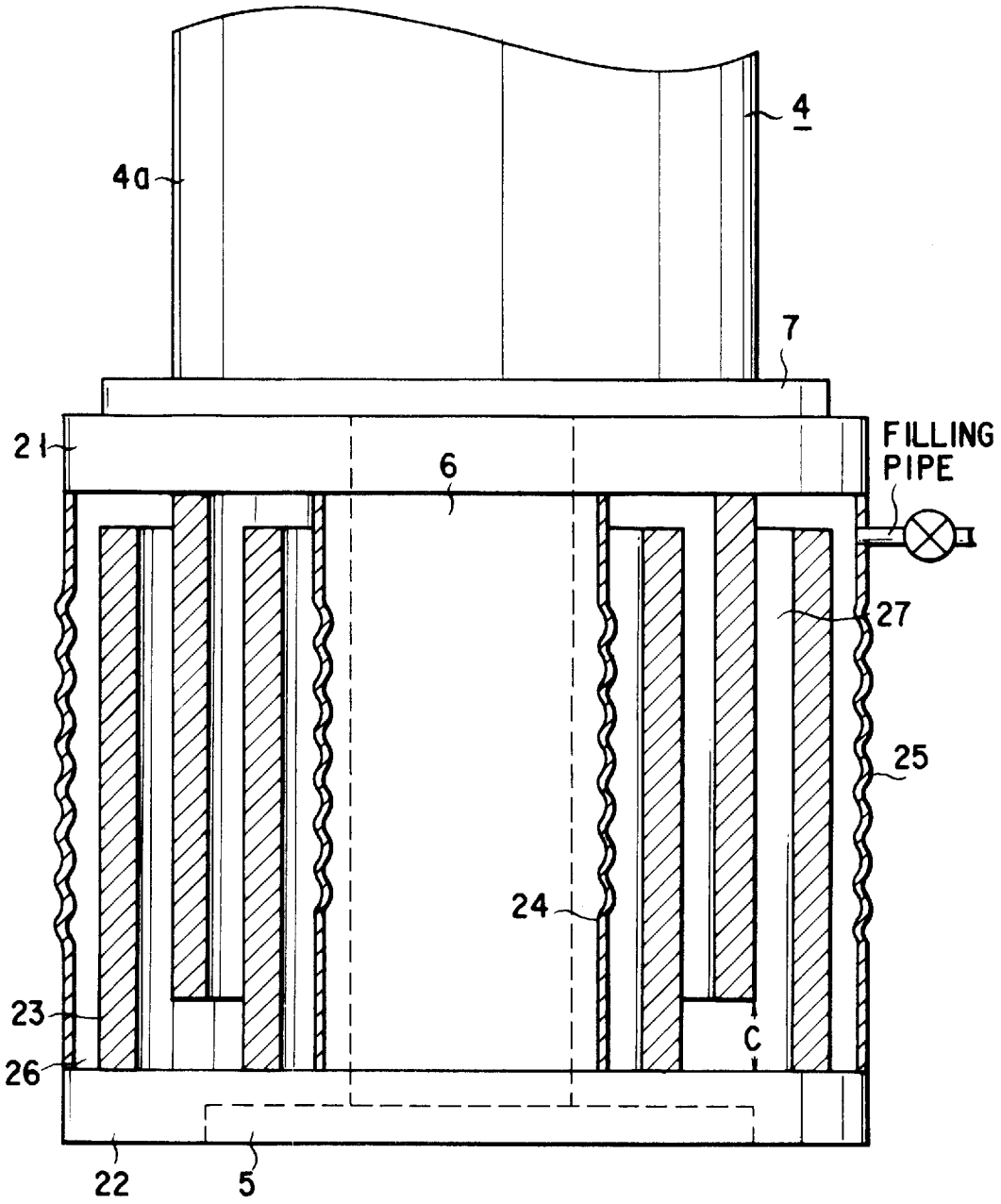
FIG. 3 shows the structure of a thermal switch in the first embodiment.

FIG. 3 shows a detailed structure of the thermal switch 20 disposed coaxially with the low-temperature-side cylinder 6 of refrigerator 4.

As shown in FIG. 3, an end plate 21 is attached to the high-temperature cooling stage 7 of refrigerator 4, and an end plate 22 is attached to the low-temperature cooling stage 5 around the low-temperature-side cylinder 6.

A cylindrical member 23 is provided around the low-temperature-side cylinder 6 and is substantially perpendicularly attached to that side surface of the end plate 21 which faces the end plate 22. A plurality of cylindrical members 23 with different diameters are substantially perpendicularly attached to that side surface of the end plate 22 which faces the end plate 21.

The surfaces of the cylindrical members 23 are formed of polished surfaces, so radiation heat transfer between the cylindrical member 23 attached to the high-temperature cooling stage 7 and the cylindrical members 23 attached to the low-temperature cooling stage 5 is reduced.

The cylindrical members 23 attached to the low-temperature cooling stage 5 and high-temperature cooling stage 7 are arranged to keep a small distance between each other. The space in which the cylindrical members 23 are arranged constitutes a hermetically sealed container 26 defined by an inner wall 24 and an outer wall 25.

The thermal switch is a sealed container comprising coaxially arranged thin cylindrical heat transfer members.

The inner wall 24 and outer wall 25 of the sealed container are attached to the high-temperature cooling stage 7 and low-temperature cooling stage 5 of refrigerator 4 with the end plates 21 and 22 interposed.

Accordingly, if the temperature of the high-temperature cooling stage 7 becomes lower than that of the low-temperature cooling stage 5, it is necessary to prevent heat conduction from the high-temperature cooling stage 7 to the low-temperature cooling stage 5.

For this purpose, it is necessary to form the inner wall 24 and outer wall 25 of the thermal switch of a material with low thermal conductivity, necessary to reduce their thickness and to increase as much as possible the distance of heat conduction between the high-temperature cooling stage 7 and the low-temperature cooling stage 5.

The inner wall 24 and outer wall 25 of the thermal switch in this embodiment are formed of stainless steel or titanium. In addition, the inner wall 24 and outer wall 25 are formed to have a bellows structure with a thickness of about 1 mm, thereby to increase the distance of heat conduction between the high-temperature cooling stage 7 and the low-temperature cooling stage 5.

The sealed container 26 is filled with a gas 27 such as nitrogen gas. Since the end plates 21 and 22 and cylindrical members 23 are formed of a metal such as oxygen-free-high-thermal conducting copper, the temperatures of the end plate 21 and cylindrical members 23 attached to the end plate 21 become substantially equal to the temperature of the high-temperature cooling stage 7.

Similarly, the temperatures of the end plate 22 and cylindrical members 23 attached to the end plate 22 become substantially equal to the temperature of the low-temperature cooling stage 5.

A method of cooling the superconducting magnet apparatus using the cryogenic cooling apparatus having the above structure will now be described.

When the cooling of the superconducting coil 1 by the refrigerator 4 is started from room temperature, the thermal plate 8 put in contact with the high-temperature cooling stage 7 having a high refrigerating capacity is cooled at first. The temperature of the cylindrical members 23 of the thermal switch attached to the high-temperature cooling stage 7 decreases gradually too.

On the other hand, the superconducting coil 1 put in contact with the low-temperature cooling stage 5 having a low refrigerating capacity remains at nearly room temperature. Thus, the temperature of the cylindrical members 23 of the thermal switch 20 attached to the high-temperature cooling stage 7 of refrigerator 4 is lower than that of the cylindrical members 23 of the thermal switch 20 attached to the low-temperature cooling stage 5 of refrigerator 4.

In this state, heat is transferred via the gas from the cylindrical members 23 of the low-temperature cooling stage 5 to the cylindrical members 23 of the high-temperature cooling stage 7. The heat transfer via the gas continues until the filled gas is liquefied and then solidified.

The heat conduction via the gas will now be described.

When the temperature of the cylindrical members 23 attached to the high-temperature cooling stage 7 approaches the boiling point of the filled gas, the gas begins to liquefy. Until the temperature of the cylindrical members 23 attached to the high-temperature cooling stage 7 is above the boiling point of the filled gas, the heat conduction is mainly effected via the gas-phase medium.

If the liquefication of the gas begins, heat transport via liquid drops is effected. Specifically, drops of the liquefied gas fall on the end plate 22 attached to the low-temperature cooling stage 5, and the drops of liquefied gas is evaporated once again at low-temperature cooling stage 5 which has a higher temperature than the temperature of the high-temperature cooling stage 7.

When the liquefied gas is evaporated, heat is absorbed as latent heat from the cylindrical members 23 of the low-temperature cooling stage 5, which is at a high temperature.

The evaporated gas is liquefied once again by the low-temperature cylindrical members 23 attached to the high-temperature cooling stage 7 and heat is transferred to the cylindrical members 23 attached to the high-temperature cooling stage 7.

Until the filled gas is solidified, heat transportation is continued from the cylindrical members 23 attached to the low-temperature cooling stage 5 to the cylindrical members 23 attached to the high-temperature cooling stage 7 via the drops of the liquefied gas. In this case, until the temperature of the liquefied gas reaches the solidification point, the heat transport is mainly effected via repeated phase-change of the filled gas.

The heat transportation via the gas 27 filled in the sealed container 26 is completed when the temperature of the cylindrical members 23 attached to the high-temperature cooling stage 7 reaches the boiling point of the gas when the gas is liquefied, and goes below the triple point to the solidification point, when the gas 27 is solidified.

When the gas 27 is in the gas-phase, the high-temperature cooling stage 7 and low-temperature cooling stage 5 are thermally connected to each other via heat conduction through the gas filled in the thermal switch located between both stages 7 and 5, i.e. the thermal switch is set in the "turn-on" state.

When the gas has been solidified, a vacuum space is created between the stages 7 and 5. Thus, the high-temperature cooling stage 7 and low-temperature cooling stage 5 are thermally disconnected from each other, i.e. the thermal switch is set in the "turn-off" state. As described above, the sealed container 26 has no communication with outside the sealed container 26 during an operation of a thermal switch.

Thereafter, the thermal shield 8 is cooled by the high-temperature-thermal cooling stage 7 and the superconducting coil 1 is cooled by the low-temperature cooling stage 5 respectively to steady-state temperatures.

The quantity Q of heat conduction from point A to point B in an conducting medium is expressed by $$Q=\lambda\cdot S\cdot(t1-t2)/\Delta x \quad (1)$$

where t1=the temperature at point A, t2=the temperature at point B,

Δx=the distance between objects A and B,

S=the heat conduction area, and

λ=the thermal conductivity.

If this equation is applied to the present embodiment, t1 is the temperature of the cylindrical members 23 attached to the low-temperature-side cooling stage 5, t2 is the temperature of the cylindrical members 23 attached to the high-temperature cooling stage 7, Δx is the gas gap between two adjacent cylindrical members 23, S is the surface area of the cylindrical members, and λ is the thermal conductivity of the gas.

If thermal resistance K is expressed by $$K=\Delta x/(\lambda\cdot S) \quad (2)$$

equation (1) simplifies to $$KQ=t1-t2 \quad (3)$$

It is understood from equation (3), that the temperature difference (t1−t2) increases as the value K increases, or when the heat conducted Q increases.

Figure 4:
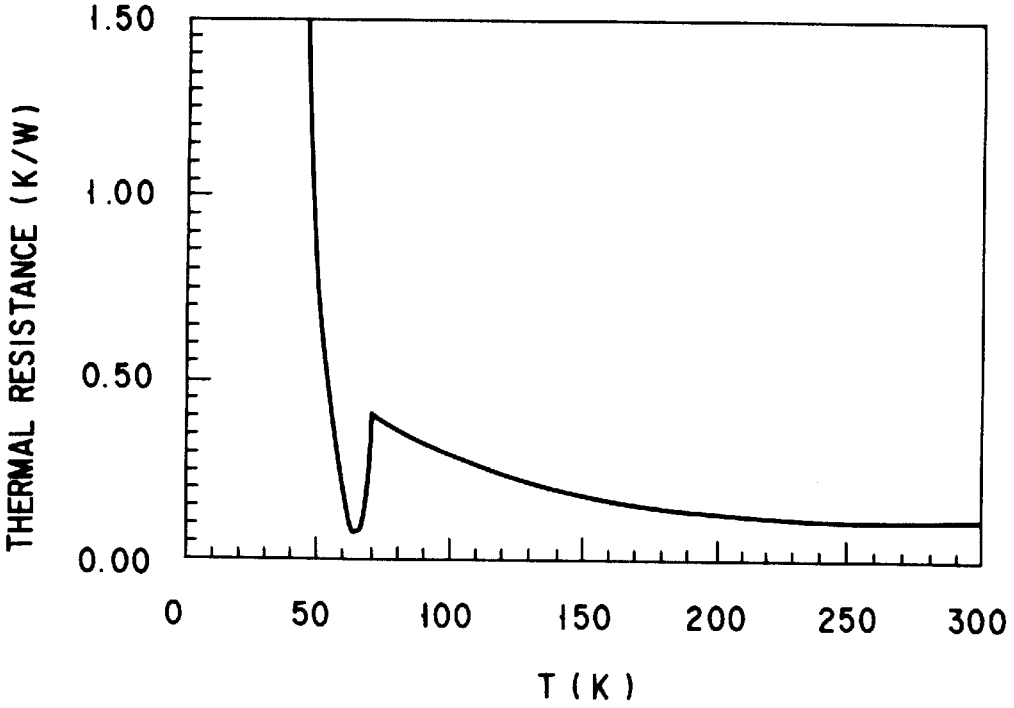
FIG. 4 is a graph showing the relationship between the thermal resistance of the thermal switch and temperature.

FIG. 4 shows the relationship between the thermal resistance of the thermal switch and temperature when nitrogen is used.

As shown in FIG. 4, the thermal resistance increases slightly in the range of temperatures from room temperature (300 K) to the boiling point of nitrogen, i.e. about 70 K. The heat transportation was effected via heat conduction through about a nitrogen gas temperature of about 70 K. The heat resistance decreases steeply in the vicinity of 70 K. The reason for this is that the thermal switch begins to function as a heat pipe. That is, heat transportation via liquefied nitrogen occurred.

If the temperature of the switch is lowered by a large amount, the liquefied nitrogen begins to gradually freeze. Consequently, the function of the heat pipe is diminished and the thermal resistance increases steeply. When the liquefied gas is completely frozen, the switch is set in the "turn-off" state.

As understood from equations (2) and (3), in order for the low-temperature cooling stage 5 of the refrigerator to be cooled as quickly as possible, it is necessary to decrease as much as possible the gap between the adjacent cylindrical members 23 of the thermal switch. Because of manufacture limitations, the gap between the cylindrical members of the thermal switch according to the embodiment shown in FIG. 2 is set at about 1 mm.

In FIG. 3, an adequate distance C is provided so that the liquefied and solidified gas collected at the bottom region may not couple the cylindrical members 23 permitting heat conduction.

The selection of the gas relating to the aforementioned thermal conductivity will now be described.

The "turn-off" temperature of the thermal switch, i.e. the temperature at which heat conduction from the cylindrical members 23 attached to the low-temperature cooling stage 5 to the cylindrical members 23 attached to the high-temperature cooling stage 7 is completed, can be controlled by the boiling point of the gas 27. In other words, the temperature at which the thermal switch is turned off is determined by the selected gas.

Table 1 shows the boiling points of some typical gases having boiling points below room temperature.

TABLE 1

| | Boiling points (K.) | Triple points (K.) |
|---|---|---|
| n-$H_2$ | 20.28 | 13.81 |
| Ne | 27.10 | 24.55 |
| N | 77.34 | 63.14 |
| CO | 81.67 | 68.09 |
| Ar | 87.26 | 83.82 |
| $CH_4$ | 111.67 | 90.67 |
| NO | 121.4 | 109.5 |
| $CF_4$ | 145.2 | 86.4 |
| $O_3$ | 161.3 | 80.5 |
| $CCIF_3$ | 191.7 | 92.0 |
| $CH_3Cl$ | 248.9 | 175.4 |
| $CH_3Br$ | 276.7 | 179.5 |

The temperature of the low-temperature cooling stage 5 of refrigerator 4 is lowered more than that of the high-temperature cooling stage 7, but has a lower refrigerating capacity. Accordingly, in order to efficiently and quickly cool the superconducting coil 1, it is necessary to make use of the high-temperature cooling stage 7 as an auxiliary cooling means until the temperature of the low-temperature cooling stage 5 decreases as much as possible.

In other words, it is desirable to turn off the thermal switch at the lowest possible temperature.

It is understood from TABLE 1 that if n-$H_2$ gas is used in the thermal switch, the refrigerating capacity of the low-temperature cooling stage 5 can be backed up by the high-temperature cooling stage 7 down to about 20 K. Once the thermal switch is turned off at temperatures below 20 K, the superconducting coil 1 is cooled down to 4 Kby the low-temperature cooling stage 5 alone.

In this case, n-$H_2$ (normal hydrogen) is a mixture of 75% o-$H_2$ (ortho-hydrogen) and 25% p-$H_2$ (para-hydrogen).

In the cryogenic cooling apparatus of this embodiment, nitrogen gas used for pre-cooling is used as a filling gas in the switch, because nitrogen gas is inexpensive and easy to handle. When nitrogen gas is used, the thermal switch is turned off at about 50 K, as shown in FIG. 4. At temperatures below 50 K, the superconducting coil 1 is cooled down to 4 K only by the refrigerating performance of the low-temperature cooling stage 5 of the refrigerator 4.

Accordingly, there is provided a cryogenic cooling apparatus with a thermal switch, wherein the super-conducting coil 1 can be efficiently cooled by the refrigerator 4 alone, without the need to use a refrigerant such as liquid nitrogen for pre-cooling.

Furthermore, since the thermal switch 20 and refrigerator 4 are integrated, the size of the cryogenic cooling apparatus can be reduced.

<Second Embodiment>

Figure 5:
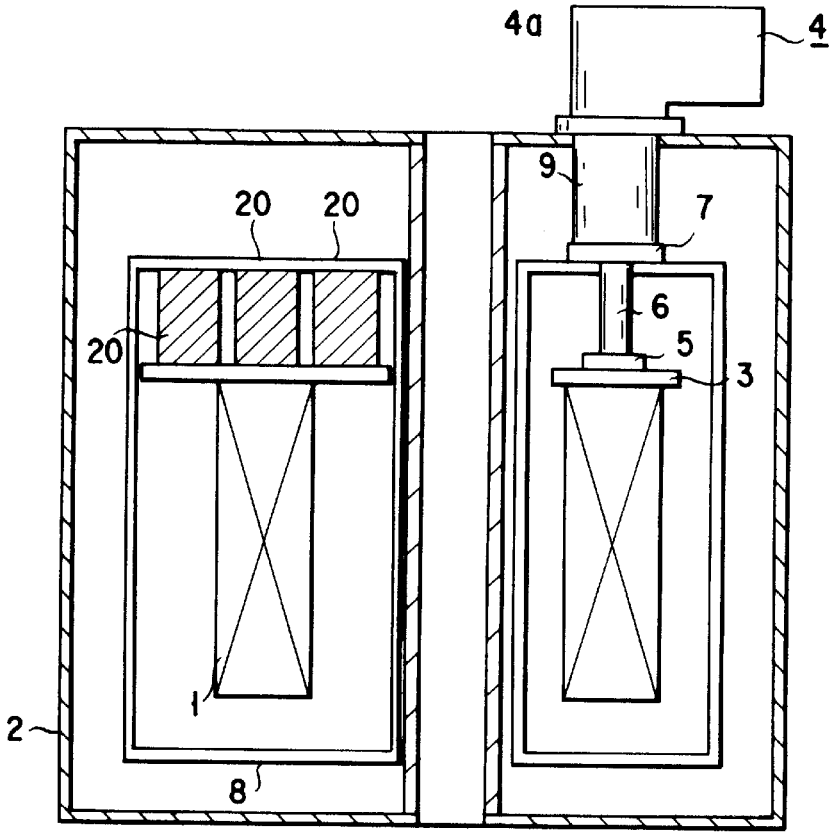
FIG. 5 shows the structure of a cryogenic cooling apparatus according to a second embodiment of the invention.

FIG. 5 shows the structure of a cryogenic cooling apparatus according to a second embodiment of the invention.

As shown in FIG. 5, in the cryogenic cooling apparatus of this embodiment, three thermal switches 20 are provided between the high-temperature cooling stage 7 and low-temperature cooling stage 5 of the refrigerator 4.

This embodiment does not adopt the technique of using one kind of gas and cooling the superconducting coil 1 efficiently. In this embodiment, two or more kinds of gases having different boiling points and triple points are used, thereby widening the temperature range for heat transport via drops of gas and operating the thermal switches at the lowest possible thermal resistances.

If two or more gases having different boiling points and triple points are properly selected, the temperature range for heat transportation via drops of liquefied gas can be widened.

In this embodiment, the three thermal switches are filled with different gases, respectively. For example, the three thermal switches are filled with $O_3$ gas, CO gas and Ne gas, respectively. The heat transportation by the gases in this case will now be described.

When the temperature of the cylindrical members attached to the high-temperature cooling stage 7 has reached 161.3 K or the boiling point of $O_3$, heat transportation from the low-temperature cooling stage 7 via liquid drops begins in the $O_3$-filled thermal switch.

This heat transportation continues until the temperature of the cylindrical members reaches about 80.5 K or the triple point. When the heat transportation by the heat pipe function of $O_3$-filled thermal switch is about to end, the heat transportation by the heat pipe function of the CO-filled thermal switch begins. Subsequently, the heat transportation by the heat pipe function of the Ne-filled thermal switch begins.

As has been described above, in the present embodiment, three kinds of gases are used. Thereby, the temperature range for heat transportation via liquid drops between the high-temperature cooling stage 7 and low-temperature cooling stage 5 of the refrigerator 4 can be increased to a range between about 161 K and about 26 K.

<Third Embodiment>

Figure 6:
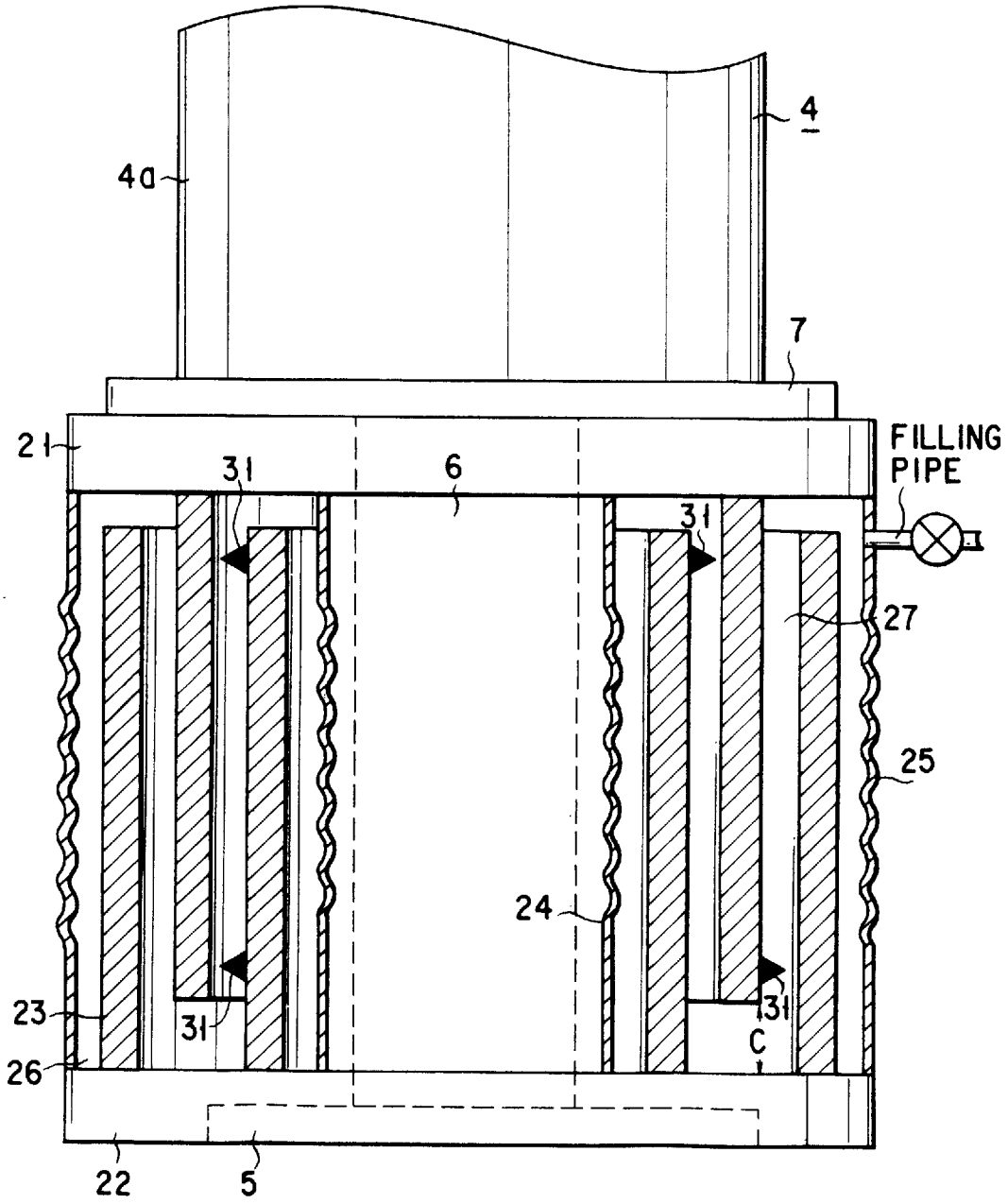
FIG. 6 shows the structure of a thermal switch in which contact prevention members 31 are provided between a high-temperature-side heat transfer member and low-temperature-side heat transfer members.

FIG. 6 shows the structure of a thermal switch in which contact prevention members 31 are provided between a high-temperature-side heat transfer member and low-temperature-side heat transfer members.

As shown in FIG. 6, the contact prevention members 31 are attached to free end portions of the heat transfer members. An end portion of each contact prevention member 31 is pointed, like a pin, thereby preventing heat conduction via the contact prevention members 31 when the end portions of the contact prevention members 31 have come into contact with the heat transfer members.

For this purpose, the contact prevention members 31 are formed of a low thermal conductivity material such as stainless steel or titanium.

According to the cryogenic cooling apparatus with this structure, it is possible to prevent in such an event as when the superconducting coil quenches, eddy currents induced on the surfaces of the heat transfer members and thereby preventing the heat transfer members being pulled toward the superconducting coil. Therefore, the thermal switch can function even after the quenching of the superconducting coil.

The present invention is not limited to the above embodiments.

For example, in the above embodiments, the refrigerator 4 is provided coaxially with the thermal switch. The refrigerator 4 and thermal switch may be separately provided.

Specifically, if the thermal switch is disposed so as to come in contact with the two cooling stages of the refrigerator 4, the same effect as in the above embodiments can be obtained.

In the above embodiments, cylindrical thermal switches have been described. The shape of the thermal switch, however, may be hollow-prismatic. The heat transfer member may have not only a cylindrical shape, but also a thin-plate shape, a rod shape, a comb shape, or a helical shape.

Figure 7:
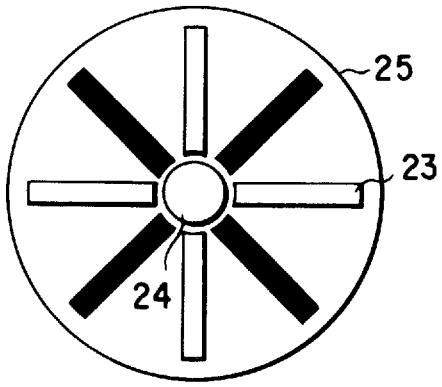
FIG. 7 is a view for describing the structure of a thermal switch having a cylindrical container in which plate heat transfer members are radially arranged.
Figure 8:
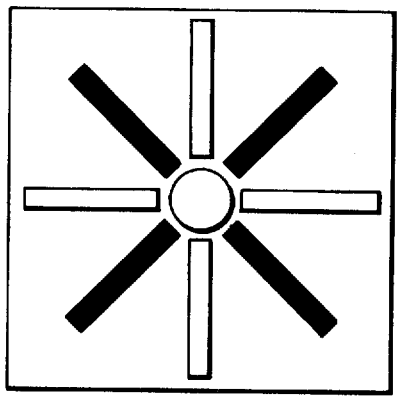
FIG. 8 is a view for describing the structure of a thermal switch having a prismatically shaped container in which plate heat transfer members are radially arranged.

FIG. 7 is a view for describing the structure of a cylindrical thermal switch in which plate heat transfer members are radially arranged, with respect to the low-temperature cylinder. and FIG. 8 is a view for describing the structure of a thermal switch having a prismatically shaped container in which plate heat transfer members are radially arranged.

Figure 9A:
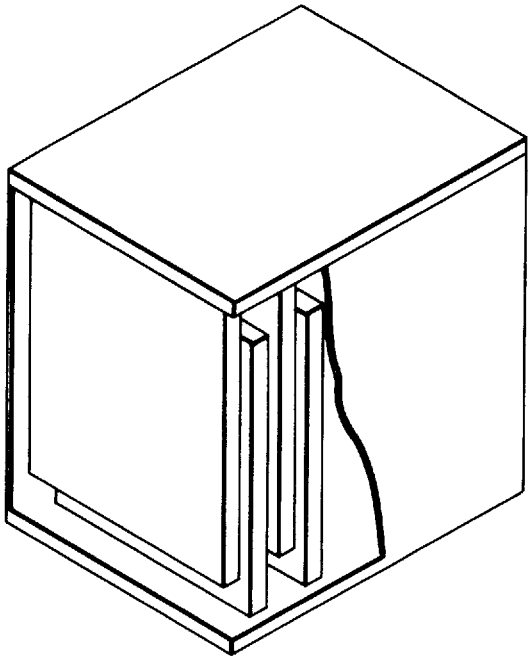
FIG. 9A is a perspective view showing a thermal switch having a prismatically shaped container in which plate heat transfer members are arranged in parallel.
Figure 9B:
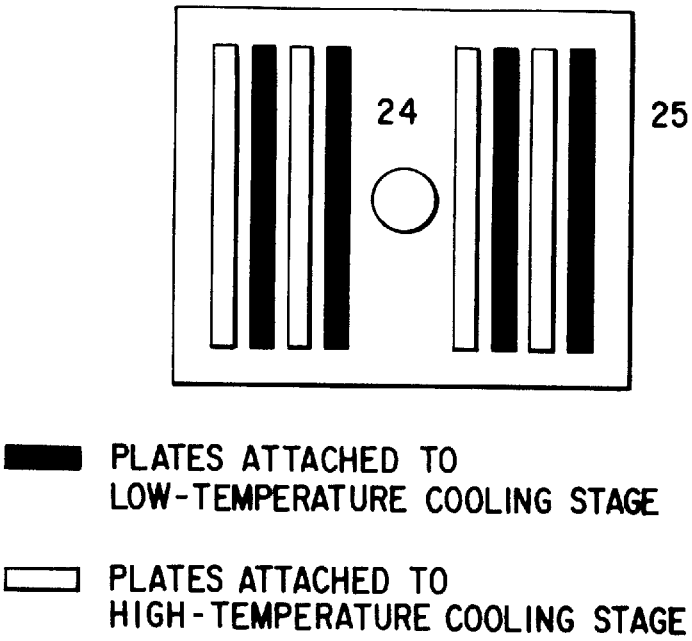
FIG. 9B is a view for describing the structure of a thermal switch having a prismatically shaped container in which plate heat transfer members are arranged in parallel.

FIG. 9A is a perspective view showing a thermal switch having a prismatically shaped container in which plate heat transfer members are arranged in parallel, and FIG. 9B is a view for describing the structure of a thermal switch having a prismatically shaped container in which plate heat transfer members are arranged in parallel.

Figure 10A:
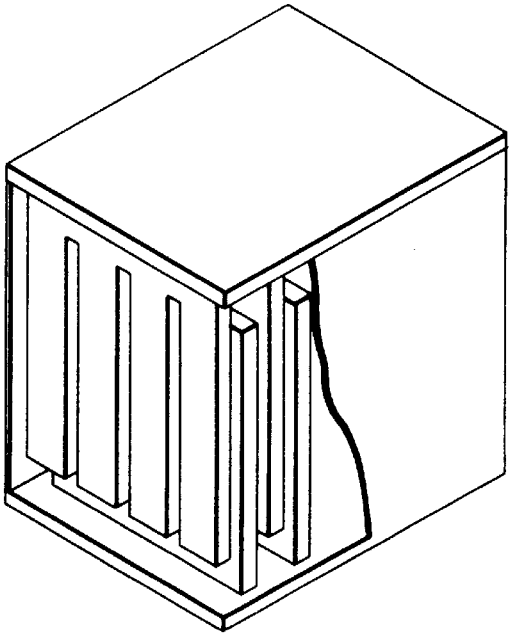
FIG. 10A is a perspective view showing a thermal switch having a prismatically shaped container in which comb-shaped heat transfer members are arranged in parallel.
Figure 10B:
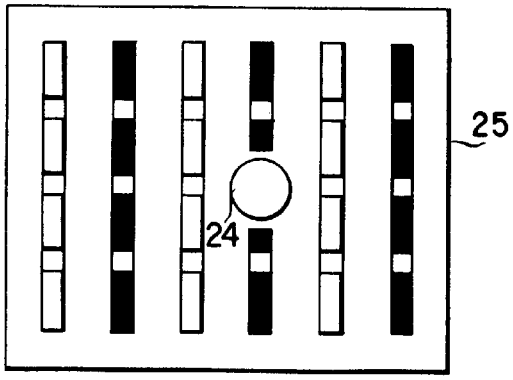
FIG. 10B is a view for describing the structure of a thermal switch having a prismatically shaped container in which comb-shaped heat transfer members are arranged in parallel.

FIG. 10A is a perspective view showing a thermal switch having a prismatically shaped container in which comb-shaped heat transfer members are arranged in parallel, and FIG. 10B is a view for describing the structure of a thermal switch having a prismatically shaped container in which comb-shaped heat transfer members are arranged in parallel.

Figure 11A:
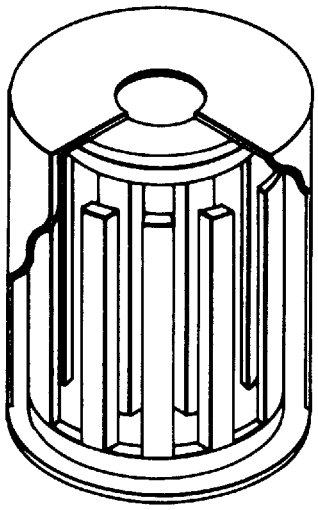
FIG. 11A is a perspective view showing a cylindrical thermal switch in which comb-shaped heat transfer members are arranged coaxially.
Figure 11B:
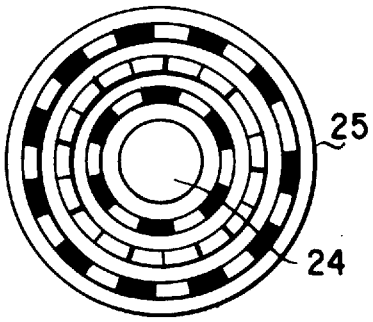
FIG. 11B is a view for describing the structure of a cylindrical prismatic thermal switch in which comb-shaped heat transfer members are arranged coaxially.

FIG. 11A is a perspective view showing a cylindrical thermal switch in which comb-shaped heat transfer members are arranged coaxially, and FIG. 11B is a view for describing the structure of a cylindrical prismatic thermal switch in which comb-shaped heat transfer members are arranged coaxially.

Figure 12A:
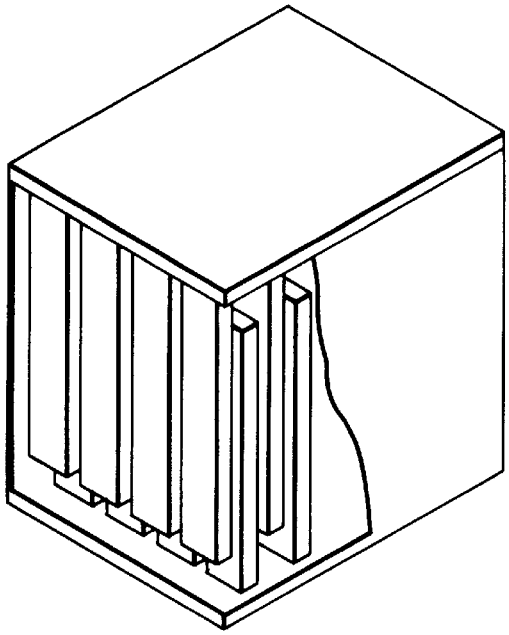
FIG. 12A is a perspective view showing the structure of a thermal switch having a prismatically shaped container in which rod-shaped heat transfer members are arranged in parallel.
Figure 12B:
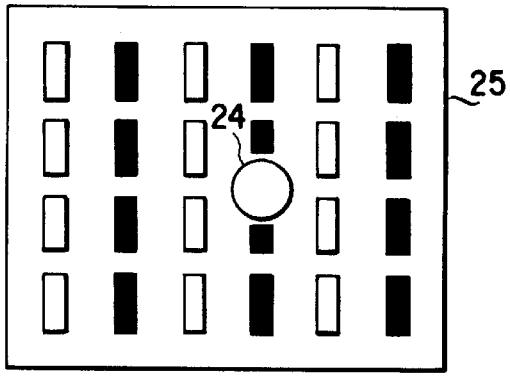
FIG. 12B is a view for describing the structure of a thermal switch having a prismatically shaped container in which rod-shaped heat transfer members are arranged in parallel.

FIG. 12A is a perspective view showing the structure of a thermal switch having a prismatically shaped container in which rod-shaped heat transfer members are arranged in parallel, and FIG. 12B is a view for describing the structure of thermal switch having a prismatically shaped container in which rod-shaped heat transfer members are arranged in parallel.

Figure 13A:
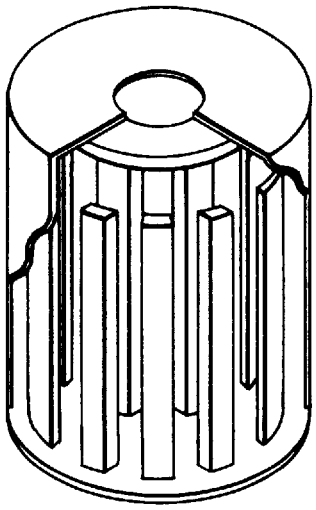
FIG. 13A is a perspective view showing the structure of a cylindrical thermal switch in which rod-shaped heat transfer members are arranged in parallel.
Figure 13B:
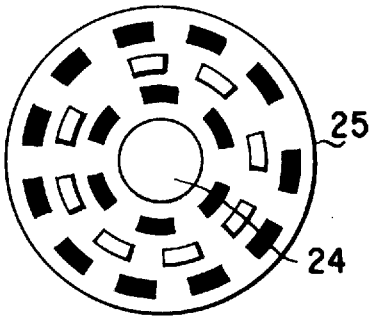
FIG. 13B is a view for describing the structure of a cylindrical thermal switch in which rod-shaped heat transfer members are arranged in parallel.

FIG. 13A is a perspective view showing the structure of a cylindrical thermal switch in which rod-shaped heat transfer members are arranged in parallel, and FIG. 13B is a view for describing the structure of a cylindrical prismatic thermal switch in which rod-shaped heat transfer members are arranged in parallel.

Figure 14A:
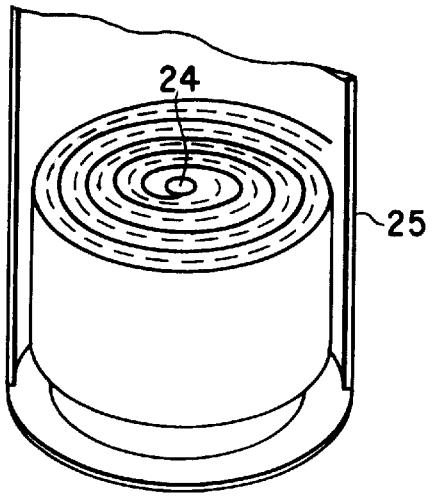
FIG. 14A is a perspective view showing the structure of a cylindrical thermal switch in which helical heat transfer members are arranged coaxially.
Figure 14B:
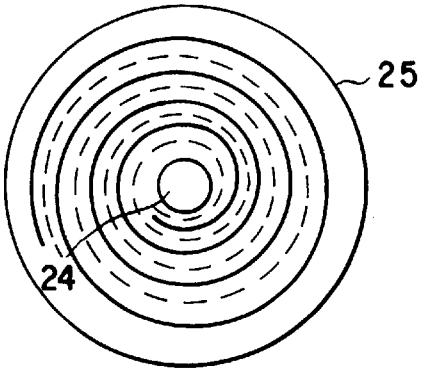
FIG. 14B is a view for describing the structure of a cylindrical thermal switch in which helical heat transfer members are arranged coaxially.

FIG. 14A is a perspective view showing the structure of a cylindrical thermal switch in which helical heat transfer members are arranged coaxially; and FIG. 14B is a view for describing the structure of a cylindrical thermal switch in which helical heat transfer members are arranged coaxially.

The contact prevention members 31 described in the third embodiment are most effective when the thermal switch comprises thin plates arranged in parallel. Needless to say, however, the contact prevention members 31 are applicable to the heat transfer members with other shapes.

Furthermore, the object to be cooled is not limited to the superconducting coil 1. This invention is applicable to any object which needs to be cooled to cryogenic temperatures.

In the cryogenic cooling apparatuses, the thermal switch is turned on by the heat conduction via the gas. If the temperature of the gas reaches the boiling point and then triple point, the gas is solidified and the thermal switch is turned off. Therefore, the object can be cooled by only the refrigerator of the cryogenic cooling apparatus, without the need to use a refrigerant for cooling the object.

Since the surfaces of the heat transfer members are polished, heat radiation among the heat transfer members can be reduced.

In addition, since the side surfaces of the sealed container is formed of a material with a low thermal conductivity in a bellows construction, the distance of heat conduction between the high-temperature cooling stage and low-temperature cooling stage can be increased and therefore the heat conduction from the high-temperature cooling stage to the low-temperature cooling stage can be reduced.

The size of the cryogenic cooling apparatus can be reduced by arranging the thermal switch coaxially with the low-temperature-side cylinder of the refrigerator.

By filling thermal switches with different kinds of gases, the temperature range in which heat is transported between the high-temperature and low-temperature cooling stages of the refrigerator as a result of phase change of the filled gases, can be increased.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A cryogenic cooling apparatus comprising:

a vacuum container for containing an object to be cooled;

at least one refrigerator for cooling the object, said refrigerator including a high-temperature cooling stage and a low-temperature cooling stage arranged at a predetermined distance from each other with a low-temperature cylinder interposed between the high-temperature cooling stage and the low-temperature cooling stage; and a thermal switch unit comprising, at least one high-temperature heat transfer member attached to said high-temperature cooling stage of said refrigerator, at least one low-temperature heat transfer member which is attached to said low-temperature cooling stage of said refrigerator and separated from said at least one high-temperature heat transfer member, and a sealed container, having no communication with an outside portion of said sealed container during an operation of said thermal switch unit and provided between said low-temperature cooling stage and said high-temperature cooling stage, for containing said at least one high-temperature heat transfer member, and a substance, heat conduction between said at least one high-temperature heat transfer member and said at least one low-temperature heat transfer member occurring via said substance when said substance is a gas.

2. The cryogenic cooling apparatus according to claim 1, wherein said at least one high-temperature heat transfer member and said at least one low-temperature heat transfer member have cylindrical shapes.

3. The cryogenic cooling apparatus according to claim 2, wiherein said at least one high-temperature heat transfer member and said at least one low-temperature heat transfer member have different diameters.

4. The cryogenic cooling apparatus according to claim 1, wherein said at least one high-temperature heat transfer member and said at least one low-temperature heat transfer member have plate shapes.

5. The cryogenic cooling apparatus according to claim 4, wherein said at least one high-temperature heat transfer member and said at least one low-temperature heat transfer member are situated substantially parallel to each other.

6. The cryogenic cooling apparatus according to claim 5, wherein said at least one high-temperature heat transfer member and said at least one low-temperature heat transfer member are situated radially with respect to said low-temperature cylinder.

7. The cryogenic cooling apparatus according to claim 6, wherein said high-temperature heat transfer member and said at least one low-temperature heat transfer member are positioned between said low temperature cylinder and said sealed container.

8. The cryogenic cooling apparatus according to claim 1, wherein said at least one high-temperature heat transfer member and said at least one low-temperature heat transfer member have polished surfaces.

9. The cryogenic cooling apparatus according to claim 1, wherein said sealed container has side walls formed of a material with a low thermal conductivity in a bellows construction.

10. The cryogenic cooling apparatus according to claim 1, wherein said thermal switch is situated coaxially with said low-temperature cylinder of said refrigerator.

11. The cryogenic cooling apparatus according to claim 1, wherein said thermal switch unit comprises a plurality of thermal switches and different kinds of gases are filled in respective of said thermal switches.

12. The cryogenic cooling apparatus according to claim 1, wherein said at least one high-temperature heat transfer member and said at least one low-temperature heat transfer member have helical shapes.

13. The cryogenic cooling apparatus according to claim 1, wherein said at least one high-temperature heat transfer member and said at least one low-temperature heat transfer member are provided with contact prevention members for preventing contact between said at least one high-temperature heat transfer member and said at least one low-temperature heat transfer member.

14. The cryogenic cooling apparatus according to claim 12, wherein said contact prevention members are formed of titanium.

15. The cryogenic cooling apparatus according to claim 12, wherein said contact prevention members are formed of stainless steel.

16. The cryogenic cooling apparatus according to claim 1, wherein said at least one high-temperature heat transfer member and said at least one low-temperature heat transfer member have comb shapes.

17. The cryogenic cooling apparatus according to claim 1, wherein said at least one high-temperature heat transfer member and said at least one low-temperature heat transfer member have rod shapes.

18. A cryogenic cooling apparatus comprising:

a vacuum container for containing an object to be cooled;

at least one refrigerator for cooling the object, said refrigerator including a high-temperature cooling stage and a low-temperature cooling stage connected to said high-temperature cooling stage via a low-temperature cylinder;

a thermal switch unit having at least one high-temperature heat transfer member attached to said high-temperature cooling stage, at least one low-temperature heat transfer member attached to said low-temperature cooling stage and separated from said high-temperature heat transfer member, and a sealed container provided between said high-temperature cooling stage and said low-temperature cooling stage, said sealed container containing said low-temperature and high-temperature heat transfer members; and said sealed container containing a substance capable of existing as a gas or as a solid, heat transfer between said low-temperature and high-temperature heat transfer members occurring via said substance when said substance is a gas, said heat transfer being substantially stopped when said substance is a solid in said sealed container.

* * * * *

UNITED STATES PATENT AND TRADEMARK OFFICE

CERTIFICATE OF CORRECTION

PATENT NO. : 5,842,348

DATED : December 1, 1998

INVENTOR(S) : Tomomi KANEKO, et al.

It is certified that error appears in the above-indentified patent and that said Letters Patent is hereby corrected as shown below:

On the title page, item [54] and on top of column 1 the word CYROGENIC is misspelled. It should be:

--CRYOGENIC--

Signed and Sealed this

Eleventh Day of May, 1999

*Attest:*

Q. TODD DICKINSON

*Attesting Officer*

*Acting Commissioner of Patents and Trademarks*